US010709193B2

(12) United States Patent
Mustac

(10) Patent No.: US 10,709,193 B2
(45) Date of Patent: Jul. 14, 2020

(54) GOALIE HELMET

(71) Applicant: ZZM Enterprises, LLC, Woodbury, NJ (US)

(72) Inventor: Michael A Mustac, West Deptford, NJ (US)

(73) Assignee: ZZM Enterprises, LLC, Woodbury, NJ (US)

( * ) Notice: Subject to any disclaimer, the term of this patent is extended or adjusted under 35 U.S.C. 154(b) by 199 days.

(21) Appl. No.: 15/014,214

(22) Filed: Feb. 3, 2016

(65) Prior Publication Data

US 2017/0216707 A1 Aug. 3, 2017

(51) Int. Cl.
*A42B 3/20* (2006.01)
*A42B 3/08* (2006.01)

(52) U.S. Cl.
CPC ..... *A42B 3/205* (2013.01); *A42B 3/08* (2013.01); *A42B 3/20* (2013.01)

(58) Field of Classification Search
CPC ..... A63B 71/10; A42B 3/085; A42B 3/14; A42B 3/142; A42B 3/145; A42B 3/147; A42B 3/20; A42B 3/08; A42B 3/205; A42B 3/283; A42B 3/10; A42B 3/105; A42B 3/00; A42B 3/12; A42B 3/121; A42B 3/124; A42B 3/125; A42B 3/127; A42B 3/128; A61F 9/06; A61F 9/061; A61F 9/062; A61F 9/064; A61F 9/065; A61F 9/067; A61F 9/068
USPC ..... 2/421, 416, 417, 418, 419, 420, 8.1, 8.2, 2/8.3, 8.4, 8.5, 8.6, 8.7, 8.8
See application file for complete search history.

(56) References Cited

U.S. PATENT DOCUMENTS 2,739,309 A * 3/1956 Frieder ..... A42B 3/06 2/416
2,926,355 A * 3/1960 Finken ..... A42B 3/14 2/418
3,028,602 A * 4/1962 Miller ..... A42B 3/14 2/183
4,021,858 A * 5/1977 Neeld ..... A42B 3/08 2/9
5,121,508 A * 6/1992 Grilliot ..... A42B 3/14 2/421
5,483,699 A * 1/1996 Pernicka ..... A42B 3/22 2/424
5,694,649 A * 12/1997 Hefling ..... A42B 3/145 2/418

(Continued)

*Primary Examiner* — Anna K Kinsaul
*Assistant Examiner* — F Griffin Hall
(74) *Attorney, Agent, or Firm* — DLA Piper LLP (US)

(57) ABSTRACT

A goalie helmet has a head protective outer shell which is configured to circumscribe the head of a goalie. The shell has an interior space in which a floating head framing member is located for cradling and supporting the head of the goalie. The head framing member is located in spaced relation to and a given distance from the back or rear section of the shell of the helmet. Attachment devices, such as straps, connect the head framing member to the helmet in spaced relation to and a distance away from the rear section. The helmet also includes a unique chin cup support bracket located on its lower front section. A specifically designed chin cup is configured to be removeably positioned and secured onto the bracket. The chin cup can simply and easily be replaced on the bracket when it becomes worn.

13 Claims, 6 Drawing Sheets

(56) References Cited

U.S. PATENT DOCUMENTS 5,815,847 A * 10/1998 Holden, Jr. ..... A42B 3/125 2/418
5,898,950 A * 5/1999 Spyrou ..... A42B 3/085 2/417
5,953,761 A * 9/1999 Jurga ..... A42B 3/145 2/414
6,189,156 B1 * 2/2001 Loiars ..... A42B 3/20 2/424
6,298,497 B1 * 10/2001 Chartrand ..... A42B 3/12 2/414
6,865,752 B2 * 3/2005 Udelhofen ..... A42B 3/324 2/418
6,968,575 B2 * 11/2005 Durocher ..... A42B 3/12 2/418
7,159,249 B2 * 1/2007 Dennis ..... A42B 3/08 2/414
D628,347 S * 11/2010 Chen ..... D29/106
7,870,617 B2 * 1/2011 Butler ..... A42B 3/145 2/410
7,908,678 B2 * 3/2011 Brine, III ..... A42B 3/324 2/410
7,954,178 B2 * 6/2011 Durocher ..... A42B 3/324 2/418
8,056,150 B2 * 11/2011 Stokes ..... A42B 3/145 2/417
8,156,574 B2 * 4/2012 Stokes ..... A42B 3/324 2/417
8,856,973 B2 * 10/2014 Jourde ..... A42B 3/20 2/417
9,226,539 B2 * 1/2016 Beauchamp ..... A42B 3/324
9,781,966 B2 * 10/2017 Brine, III ..... A42B 3/124
2004/0040073 A1 * 3/2004 Morrow ..... A42B 3/08 2/424
2008/0163410 A1 * 7/2008 Udelhofen ..... A42B 3/20 2/413
2014/0259315 A1 * 9/2014 Durocher ..... A42B 3/125 2/414
2015/0033455 A1 * 2/2015 Beauchamp ..... A42B 3/08 2/414
2016/0324247 A1 * 11/2016 Warmouth ..... A42B 3/127
2017/0006951 A1 * 1/2017 Venturini ..... A42B 3/145
2017/0120134 A1 * 5/2017 Warmouth ..... A63B 71/081
2017/0291096 A1 * 10/2017 Melofchik ..... A42B 3/324
2017/0311669 A1 * 11/2017 Morin ..... A42B 3/205

* cited by examiner

GOALIE HELMET

BACKGROUND OF THE INVENTION

The protective face and head gear worn by ice hockey goalies has evolved over the years, with the primary objective being to increase the safety and well being of the player. The earliest goalies simply wore face masks for protection from hockey sticks and flying pucks. Gradually, goalie helmets which protected both the face and the head were accepted. And this type of helmet, which utilizes various designs, is routinely worn by most hockey goalies.

However, the commonly worn helmet, exemplified by helmet H in FIG. 1, has a number of distinct disadvantages. For instance, this helmet, a rear view of which is shown in the FIG. 1, is configured with an open back, enclosed solely by a back plate BP, rigidly connected by straps or other means to the rear of the helmet. This configuration permits only limited, if any, adjustment within the helmet. As a result, such a helmet often does not fit properly. This causes movement and instability of the head within the helmet and the increased possibility of head injury. Improper helmet fit is also uncomfortable, due to shifting of the head within the helmet, especially during sudden and active movements. These prior helmets also restrict airflow and circulation within the helmet, resulting in overheating and additional discomfort.

SUMMARY OF THE INVENTION

It is thus the object of the present invention to provide a helmet for a goalie which addresses the limitations and disadvantages of known goalie helmets. This and other objectives are accomplished by the present invention, a goalie helmet comprising a head protective outer shell which is configured to circumscribe the head of a goalie. The shell has an interior space in which a floating head framing member is located for cradling and supporting the head of the goalie. The head framing member is located in spaced relation to and a given distance from the back or rear section of the shell of the helmet. Attachment devices, such as straps, connect the head framing member to the helmet in spaced relation to and a distance away from the rear section. The helmet also includes a unique chin cup support bracket located on its lower front section. A specifically designed chin cup is configured to be removeably positioned and secured onto the bracket. The chin cup can simply and easily be replaced on the bracket when it becomes worn.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Goalie helmet 1 of the present invention is a major improvement over existing commonly worn helmets. FIGS. 2-6 show various views of helmet 1. For the sake of simplicity and clarity of invention, helmet 1 is shown without the protective padding which normally would be found within a goalie's helmet.

Figure 3:
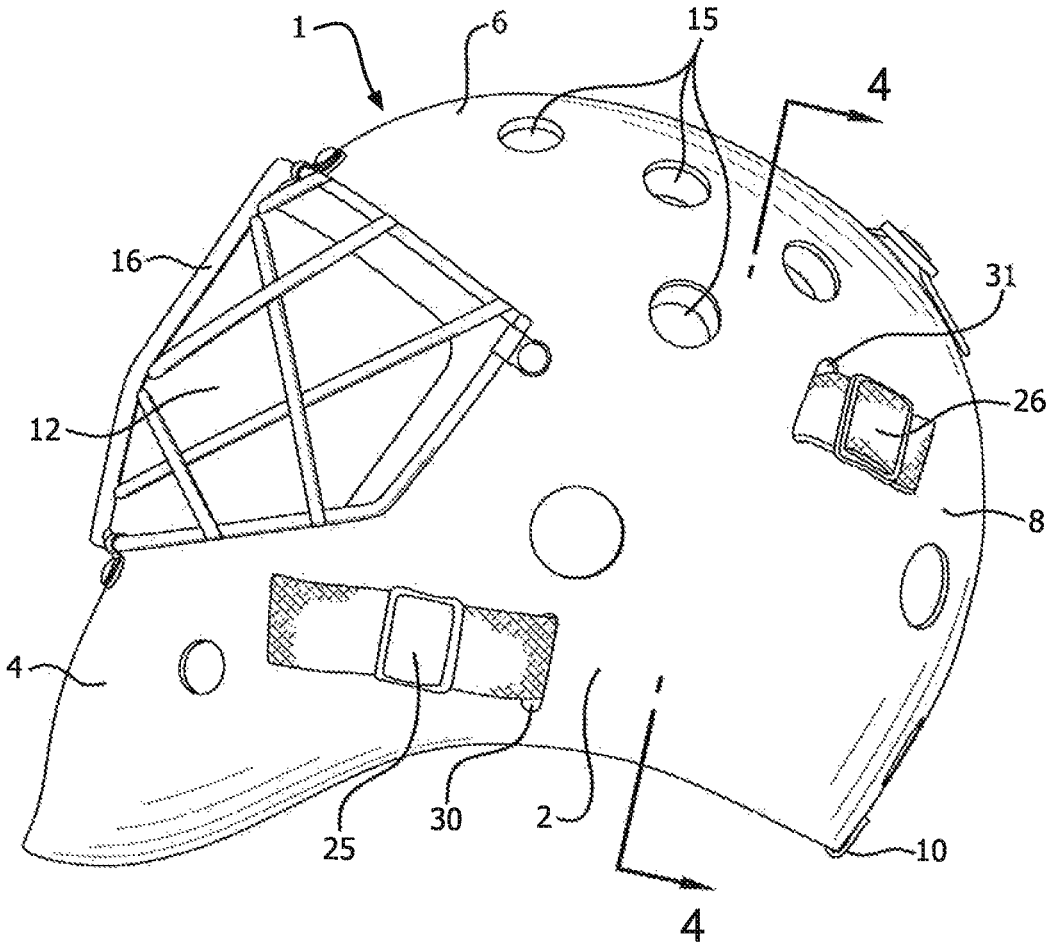
FIG. 3 is an elevation view of the goalie helmet of the present invention.

With particular reference to FIG. 3, helmet 1 comprises head protective outer shell 2 designed to circumscribe the goalie's head. Shell 2 comprises lower front section 4, top section 6, and rear section 8, extending from the top section down to the bottom 10 of helmet 1, which approximates where the neck area of the wearer. Lower front section 4, top section 6, and rear section 8 of shell 2 encloses interior space 14 of helmet 1. A plurality of air circulating holes 15 extend through shell 2. Front window 12, protected by cage 16, is provided at the front of helmet 1.

Floating head framing member 20 is elliptically shaped to conform to the back of the head of the wearer. Its purpose is to cradle and provide rigid support to the head. Framing member 20 is advantageously located within interior space 14, in spaced relation to and a given distance away from rear section 8 of shell 2. Framing member 20 is maintained in this position, in spaced relation to and a given distance away from rear section 8, by attachment means in the form of a plurality of length adjustable straps 22, 23, 24, 25 and 26 which extend between the framing member and shell 2, through openings 27, 28, 29, 30 and 31 in the shell. The adjustability of the straps provides the means to adjust the position of framing member 20 within interior space 14, in order to accommodate the position and comfort of the head of the wearer. There is thus increased support and stability for the head, thereby vastly increasing the protection and safety of the wearer.

Of significance is that strap 22, the top strap which secures framing member 20, comprises a non-elastic, non-stretchable material. This is critical to maintaining the position of the framing member, as an elastic material would allow helmet 1 to unduly move about and droop over the wearer's head. In fact, the non-elastic nature of strap 22 allows framing member 20 to pivot back and forth, almost like a hinge, while being worn by the goalie.

It is further noted that openings 27, 28, 29, 30 and 31 are large enough to allow them to be unsnapped and removed, without being cut, when removal of helmet 1 is necessary, should the goalie be injured and unconscious.

The positioning of framing member 20, a spaced apart distance from rear section 8 of shell 2 and the control opening of the framing member also allow for increased air flow around the wearer's head. Overheating is greatly reduced, enhancing the comfort of the wearer.

Figure 2:
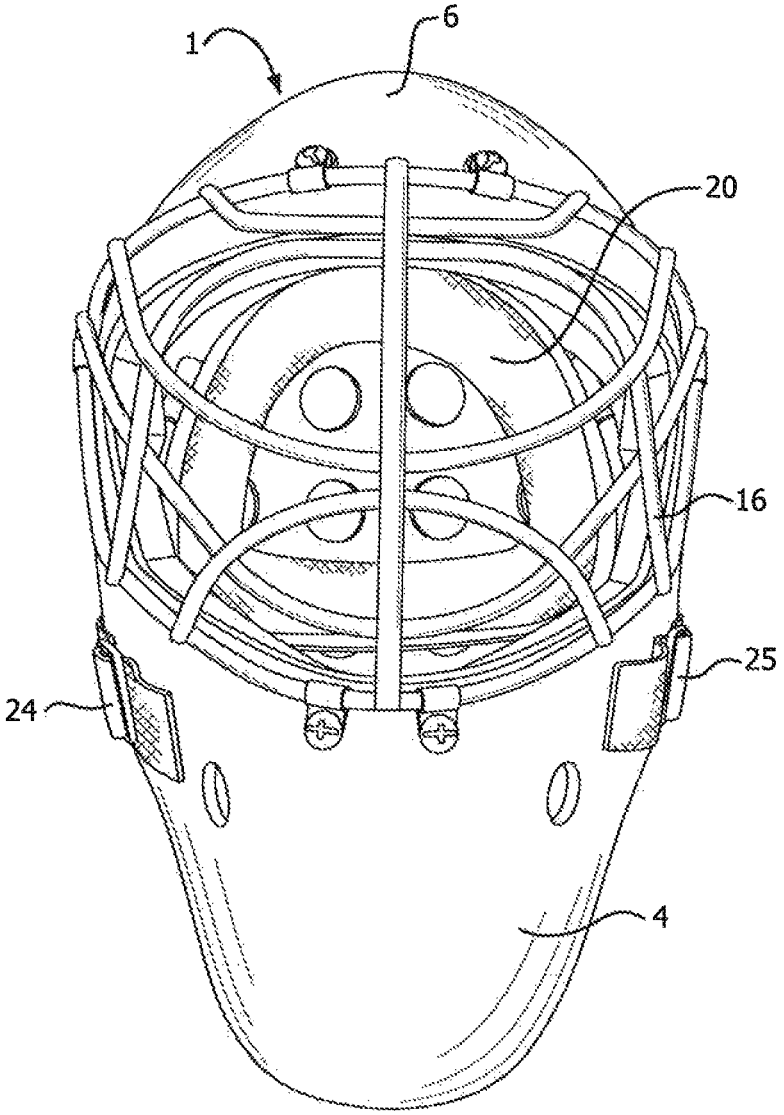
FIG. 2 is a front perspective view of the goalie helmet of the present invention.

Chin cup support bracket 40 is attached by means of screws 42 and 43 to the interior of lower front section 4 of shell 2. As seen in FIG. 2, these screws also secure the lower section of cage 16 to shell 2, by means of cage clips. Chin cup support bracket 40 comprises base member 44 and dual arm members 46 and 48, upstanding from the base member. Chin cup 50 is designed to be removeably positioned and maintained within chin cup support bracket 40. Slots 52 and 54 are located through chin cup 50. Arm members 46 and 48 are configured to extend through slots 52 and 54 in order to maintain chin cup 50 within chin cup support bracket 40. In this way chin cup 50 can easily and readily be removed from and replaced on chin cup support bracket 40, when the chin cup becomes worn or otherwise ineffective. The use of chin cup support bracket 40 and its corresponding chin cup 50 serves to further eliminate play by comfortably stabilizing the wearer's chin within helmet 1.

Figure 4:
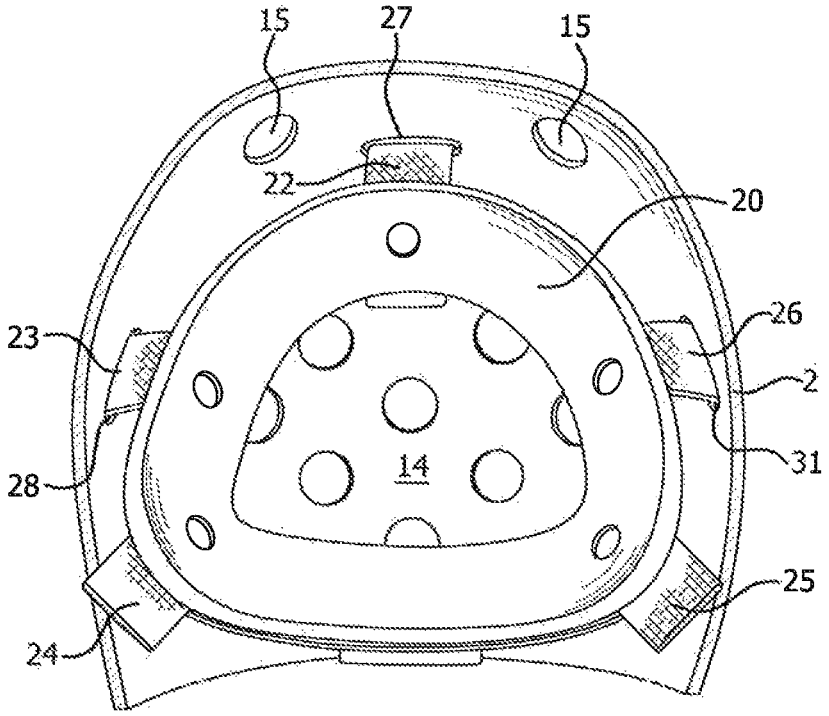
FIG. 4 is a cross-sectional view taken from FIG. 3.
Figure 5:
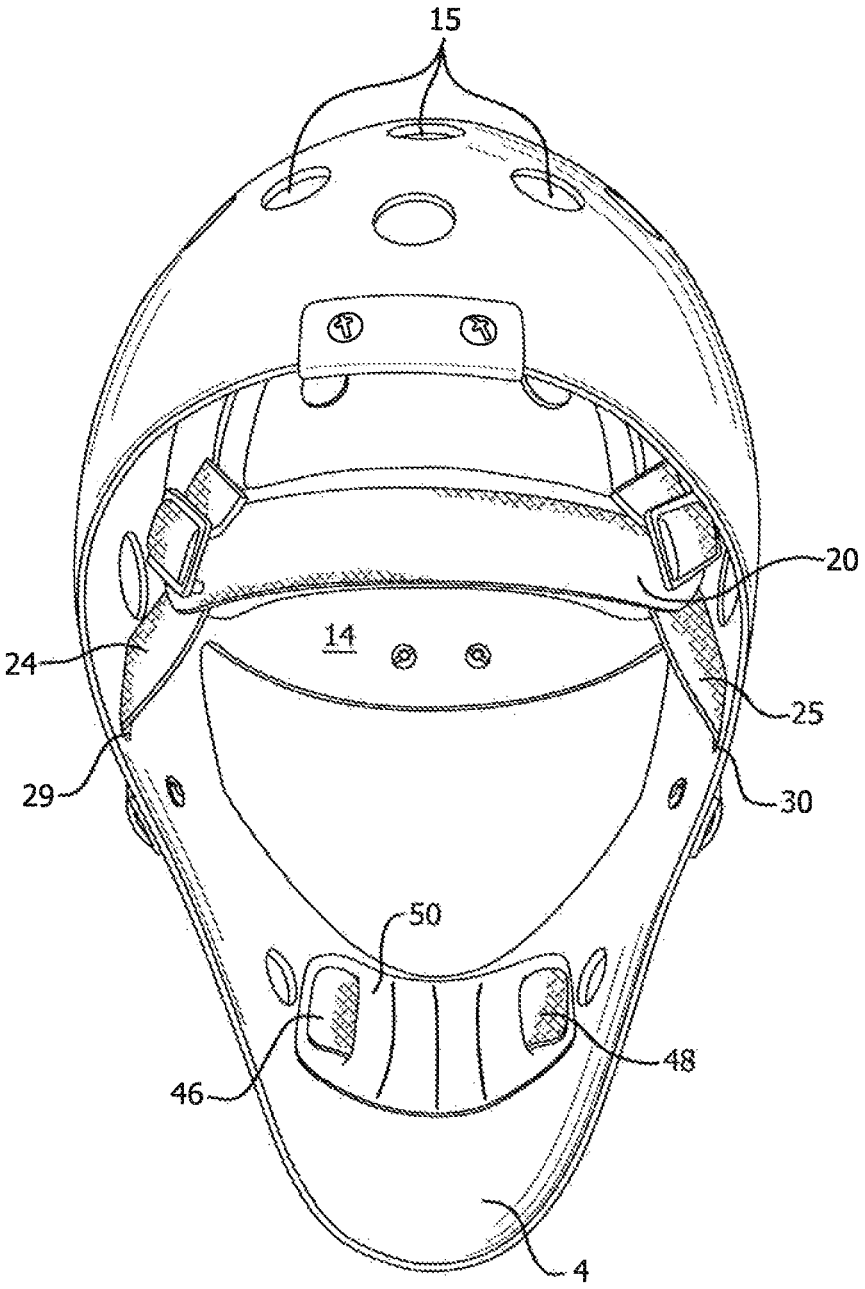
FIG. 5 is a rear perspective view of the goalie helmet of the present invention.
Figure 6:
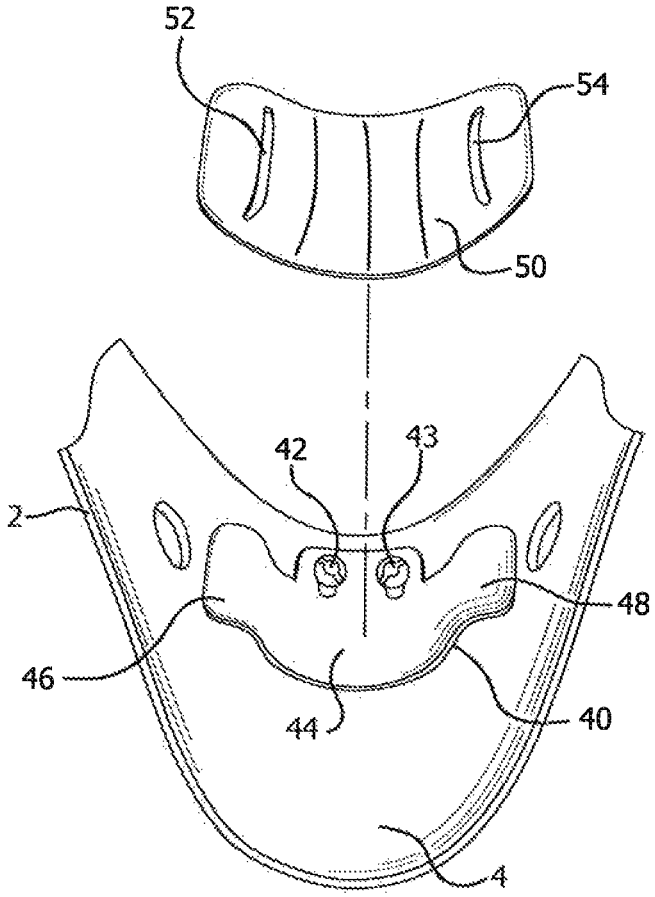
FIG. 6 is an exploded, detailed view of the chin cup support bracket and chin cup of the helmet of the present invention.

As shown in FIGS. 4 and 5, in some embodiments, head framing member 20 may be located within interior space 14 and entirely in spaced relation to and a given distance away from rear section 8. As shown in FIGS. 4 and 5, in some embodiments, straps 22, 23, 24, 25, and 26 may be located within interior space 14 coupling head framing member 20 to head protective outer shell 2 and for suspending head framing member 20 within interior space 14. As shown in FIGS. 3 and 4, in some embodiments, strap 22 may extend from top section 6 of head protective outer shell 2 to head framing member 20 and straps 23, 24, 25, and 26 may extend from sides of head protective outer shell 2 to head framing member 20. As shown in FIG. 6, in some embodiments, chin cup support bracket 40 may include an integral, one piece bracket member.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

Figure 1:
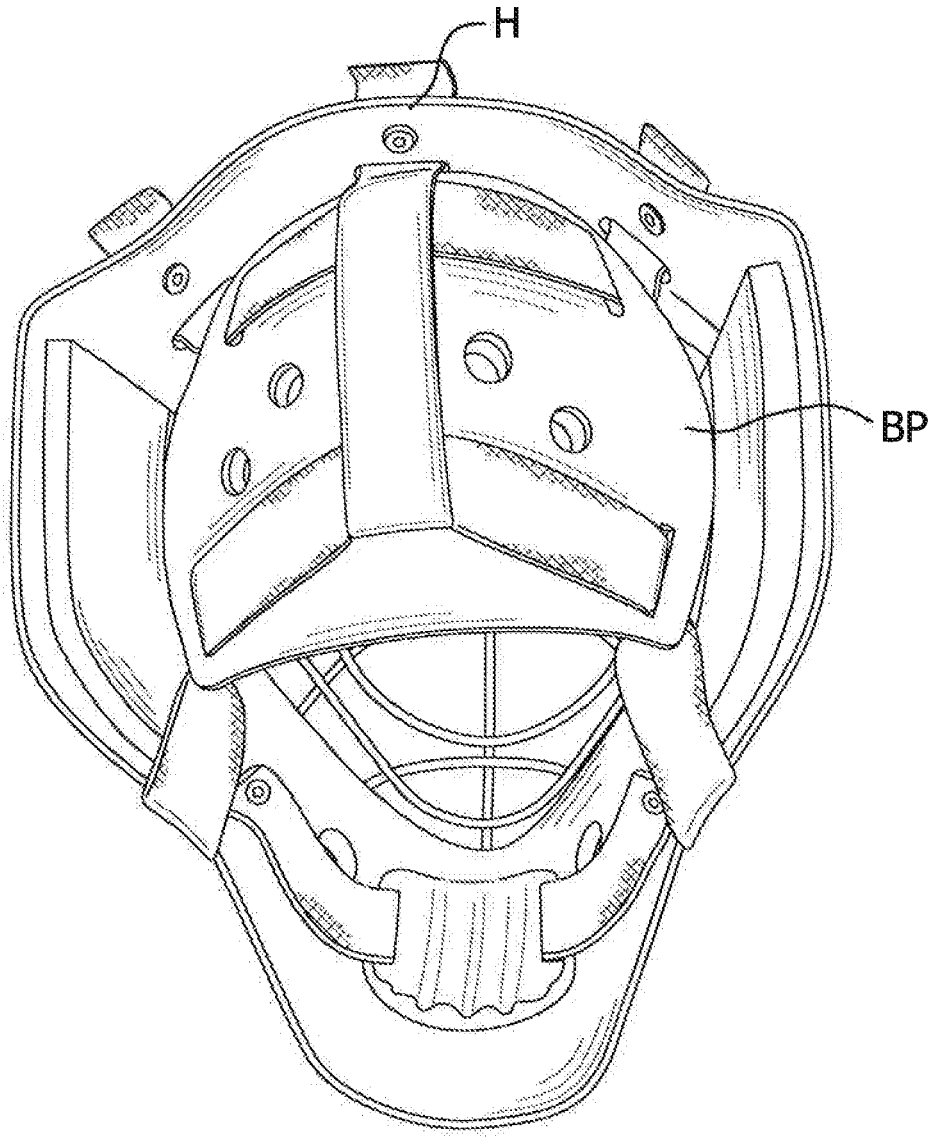
FIG. 1 PRIOR ART
FIG. 1 is a rear view of the prior art, a common goalie helmet.

In some embodiments, helmet 1 includes a head protective outer shell 2 that defines an interior space 14. The head protective outer shell 2 may be configured to completely circumscribe the head of a goalie. As shown in FIG. 3, head protective outer shell 2 may include a front portion having a lower front section and an upper front section, a rear portion comprising a lower rear section and an upper rear section, and a top portion adjacent to the front portion and the rear portion. As shown in FIG. 1, the front portion and rear portion are on opposing sides of the top portion. As illustrated in FIGS. 2, 3, and 5, the lower front section, the upper front section, the lower rear section, the upper rear section, and the top section are of unitary construction, and wherein the lower front section of the front portion extends farther from the top portion than the lower rear section of the rear portion. Helmet 1 may further include a window 12 formed in the front portion. As shown in FIGS. 2, 3, and 5 window 12 may be completely surrounded on all sides by at least the lower front section and the upper front section. Helmet 1 may further include an elliptical, free, floating head framing member 20 to be worn by the goalie and shaped to conform to the back of the head of the goalie for cradling and rigidly supporting the head. As shown in FIGS. 4 and 5, head framing member 20 may be located within interior space 14 and entirely in spaced relation to and a given distance away from the rear section portion. As clearly shown in FIGS. 4 and 5, in some embodiments, head framing member 20 may be positioned substantially vertically within interior space 14. Helmet 1 may further include attachment means 22-26 located within interior space 14 coupling the head framing member 20 to the head protective outer shell 2 and for suspending the head framing member 20 within the interior space 14 in said spaced relation to and said given distance away from the rear portion. As shown in FIGS. 4 and 5, head framing member 20 may be positioned substantially vertically within the interior space. As shown in FIGS. 4 and 5, attachment means 22-26 may include an adjustable strap member extending from the upper rear section of the head protective outer shell to the head framing member and a plurality of adjustable strap members extending from the rear portion of the head protective outer shell to the head framing member to maintain the head framing member suspended within the interior space.

As shown in FIGS. 4 and 5. head framing member 20 may be configured to pivot between two or more (along a range of positions within the interior space.

In some embodiments, such as that shown in FIGS. 3 and 5, a plane may pass vertically through a center of the head protective outer shell 2 and the front portion.

In some embodiments, such as that shown in FIG. 2, window 12 and the head framing member 20 may be at least partially aligned along an axis passing through a center of the head protective outer shell 2.

In some embodiments, such as that shown in FIGS. 2, 5, and 6, front portion may further include facemask receiving holes selectively positioned at least partially above and partially below the window. The facemask receiving holes may be configured to receive one or more fasteners coupling a facemask to front portion.

In some embodiments, such as that shown in FIG. 3, a first distance from the upper rear section to the lower rear section is less than a second distance from the upper front section to the lower front section.

In some embodiments, such as that shown in FIGS. 5 and 6, helmet 1 may include a chin cup support receiving surface positioned on an internal surface of the lower front section.

In some embodiments, such as that shown in FIGS. 5 and 6, bracket member may be secured to the internal surface of the lower front section via one or more openings formed below the window.

In some embodiments, such as that shown in FIGS. 2 and 5, one or more openings formed below the window may be configured to receive one or more fasteners coupling the chin cup to the front portion.

In some embodiments, such as that shown in FIGS. 2, 4, and 5 head framing member 20 may be substantially parallel with the rear portion.

In some embodiments, such as that shown in FIGS. 2, 4, and 5, head framing member 20 may be positioned substantially closer to the rear portion than the front portion.

The invention claimed is:

1. A helmet for a goalie comprising:

a head protective outer shell defining an interior space, the head protective outer shell configured to completely circumscribe the head of a goalie, said head protective outer shell comprising:

a front portion comprising a lower front section and an upper front section;

a rear portion comprising a lower rear section and an upper rear section;

a top portion adjacent to the front portion and the rear portion, wherein the front portion and rear portion are on opposing sides of the top portion, wherein the lower front section, the upper front section, the lower rear section, the upper rear section, and the top section are of unitary construction, and wherein the lower front section of the front portion extends farther from the top portion than the lower rear section of the rear portion; and a window formed in the front portion, wherein the window is completely surrounded on all sides by at least the lower front section and the upper front section;

an elliptical, free, floating head framing member to be worn by the goalie and shaped to conform to the back of the head of the goalie for cradling and rigidly supporting the head, the head framing member being located within the interior space and entirely in spaced relation to and a given distance away from the rear section portion, wherein the head framing member is positioned substantially vertically within the interior space and wherein the head framing member is positioned substantially closer to the rear portion than the front portion; and attachment means located within the interior space coupling the head framing member to the head protective outer shell and for suspending the head framing member within the interior space in said spaced relation to and said given distance away from the rear portion, the attachment means comprising an adjustable strap member extending from the upper rear section of the head protective outer shell to the head framing member and a plurality of adjustable strap members extending from the rear portion of the head protective outer shell to the head framing member to maintain the head framing member suspended within the interior space, wherein the head framing member is configured to pivot along a range of positions within the interior space.

2. A helmet for a goalie comprising: a head protective outer shell defining an interior space, the head protective outer shell configured to circumscribe the head of the goalie, said head protective, outer shell comprising: a top portion; a front portion extending forward and downward from the top portion, the front portion comprising a lower front section and an upper front section; a rear portion extending rearward and downward from the front portion, the rear portion comprising a lower rear section and an upper rear section, wherein the lower front section of the front portion extends farther from the top portion than the lower rear section of the rear portion; one or more side portions, wherein the top portion, the one or more side portions, the lower front section, the upper front section, the lower rear section, and the upper rear section are of unitary construction; and a window formed in the front portion, the window completely surrounded on all sides by at least the lower front section and the upper front section; and a head framing member shaped to conform to the back of the head of the goalie, the head framing member being located within the interior space and entirely in spaced relation to and a given distance away from the rear section portion, wherein the head framing member is positioned substantially vertically within the interior space and wherein the head framing member is positioned substantially closer to the rear portion than the front portion; and a chin cup support bracket comprising a bracket member, said bracket member being secured to an internal surface of the lower front section and a chin cup removeably positioned and maintained in the chin cup support bracket, wherein the chin cup support bracket comprises a central base member and dual arm members upstanding from the base member and the chin cup comprises a plurality of slots into which the arm members of the chin cup support bracket are configured to be inserted, whereby when the arm members of the chin cup support bracket are inserted into the slots of the chin cup, the chin cup is nested on and maintained in a stationary position within the chin cup support bracket and; attachment means for securing the chin cup support bracket to the lower front section.

3. The helmet of claim 1, wherein a plane passes vertically through a center of the head protective outer shell and the front portion.

4. The helmet of claim 1, wherein the window and the head framing member are at least partially aligned along an axis passing through a center of the head protective outer shell.

5. The helmet of claim 1, wherein the front portion further comprises:

one or more facemask receiving holes selectively positioned at least partially above and partially below the window, wherein the one or more facemask receiving holes are configured to receive one or more fasteners coupling a facemask to front portion.

6. The helmet of claim 1, wherein a first distance from the upper rear section to the lower rear section is less than a second distance from the upper front section to the lower front section.

7. The helmet of claim 1, further comprising:

a chin cup support receiving surface positioned on an internal surface of the lower front section.

8. The helmet of claim 2, wherein the bracket member is secured to the internal surface of the lower front section via one or more openings formed below the window.

9. The helmet of claim 8, wherein the one or more openings formed below the window are configured to receive one or more fasteners coupling the chin cup to the front portion.

10. A helmet for a goalie comprising:

a head protective outer shell defining an interior space, the head protective outer shell configured to completely circumscribe the head of a goalie, said head protective outer shell comprising:

a front portion comprising a lower front section and an upper front section;

a rear portion comprising a lower rear section and an upper rear section;

a top portion adjacent to the front portion and the rear portion, wherein the front portion and rear portion are on opposing sides of the top portion, wherein the lower front section, the upper front section, the lower rear section, the upper rear section, and the top section are of unitary construction, and wherein the lower front section of the front portion extends farther from the top portion than the lower rear section of the rear portion;

a window formed in the front portion, wherein the window is completely surrounded on all sides by at least the lower front section and the upper front section, wherein the lower front section is tapered from the window to a bottom of the lower front section, forming an acute angle at the bottom of the lower front section; and an elliptical, free, floating head framing member to be worn by the goalie and shaped to conform to the back of the head of the goalie for cradling and rigidly supporting the head, the head framing member being located within the interior space and entirely in spaced relation to and a given distance away from the rear portion, wherein the head framing member is positioned substantially vertically within the interior space and wherein the head framing member is positioned substantially closer to the rear portion than the front portion.

11. The helmet of claim 1, wherein the head framing member is substantially parallel with the rear portion.

12. The helmet as in claim 7 further comprising a chin cup support bracket secured to the internal surface of the lower front section and a chin cup removeably positioned and maintained within the chin cup support bracket.

13. The helmet as in claim 12 wherein the chin cup support bracket comprises dual upstanding arm members and the chin cup comprises a plurality of slots into which the arm members are configured to be inserted, whereby when the arm members are inserted into the slots, the chin cup is maintained in a stationary position within the chin cup support bracket.

* * * * *